US005719116A

United States Patent [19]

Vanweissenaers et al.

[11] Patent Number: 5,719,116

[45] Date of Patent: Feb. 17, 1998

[54] PROCESS FOR MANUFACTURE OF A HIGH ACTIVE DETERGENT COMPOSITION CONTAINING SUCCINIC ACID

[75] Inventors: Noel Alfons-Gustaaf Vanweissenaers, Londerzeel; Luc Marie Willy Lievens, Aalst, both of Belgium

[73] Assignee: The Procter & Gamble Company, Cincinnati, Ohio

[21] Appl. No.: 318,612

[22] PCT Filed: Mar. 29, 1993

[86] PCT No.: PCT/US93/02943

§ 371 Date: Jan. 6, 1995

§ 102(e) Date: Jan. 6, 1995

[87] PCT Pub. No.: WO93/21290

PCT Pub. Date: Oct. 28, 1993

[30] Foreign Application Priority Data

Apr. 10, 1992 [EP] European Pat. Off. ..... 92201034

[51] Int. Cl.[6] ..... C11D 11/04; C11D 1/04; C11D 17/00

[52] U.S. Cl. ..... 510/434; 510/337; 510/339; 510/435; 510/477; 510/535

[58] Field of Search ..... 252/174.19, 546, 252/89.1, DIG. 14; 554/148, 156, 160; 510/434, 435, 337, 339, 477, 535

[56] References Cited

U.S. PATENT DOCUMENTS

| | | | |
|---|---|---|---|
| 3,579,453 | 5/1971 | Dupre et al. | 252/89 |
| 4,277,378 | 7/1981 | Tsujii et al. | 252/546 |
| 4,486,338 | 12/1984 | Ootani et al. | 252/545 |
| 4,715,980 | 12/1987 | Lopes et al. | 252/106 |
| 4,985,177 | 1/1991 | Tosaka et al. | 252/547 |

FOREIGN PATENT DOCUMENTS 0 028 850 A1 10/1980 European Pat. Off. .

*Primary Examiner*—Douglas J. McGinty
*Assistant Examiner*—Ardith Hertzog
*Attorney, Agent, or Firm*—Michael D. Jones; George W. Allen; Jerry J. Yetter

[57] ABSTRACT

A process for making a concentrated liquid detergent composition comprising the steps of: i) mixing succinic anhydride, water and an alkaline catalyst, wherein the ratio of succinic anhydride to water is at least 4:1; ii) allowing an exothermic hydrolysis reaction to take place in a buffer tank, and iii) mixing the resulting highly active, partly neutralised succinic acid with other detergent ingredients.

18 Claims, No Drawings

PROCESS FOR MANUFACTURE OF A HIGH ACTIVE DETERGENT COMPOSITION CONTAINING SUCCINIC ACID

BACKGROUND

Succinic acid and its salts are known ingredients of detergent compositions. They are used for their surface active and hydrotropic properties as well as calcium and magnesium binding capacity.

They are easily processed directly into a detergent liquid or slurry by in situ hydrolysis of the corresponding succinic anhydride, and subsequent neutralisation.

This hydrolysis typically requires a considerable excess of water and the presence of solvents (eg. lower alcohols), in an alkaline environment in order to make the hydrolysis reaction move rapidly to completion.

There is now a trend to more concentrated detergents containing very little water. As the water level is decreased in the hydrolysis step the rate of reaction decreases and undesirable side reactions between the anhydride and the solvents forming, for example esters, start to become significant.

Various prior art has dealt with detergent compositions containing succinic acid. These applications are in general, dilute.

GB-A-2 049 723, published Dec. 31, 1980, discloses a composition containing partly neutralised succinic acid with one of its salts such that the pH is in the range from 5.5 to 8.0. It describes liquid compositions containing 3%–50% by weight of the partly neutralised succinic acid.

EP 0 028 850, published May 5, 1981, discloses a .liquid detergent composition containing succinates and a low level of alkyl benzene sulphonate, for improved storage stability. The application mentions the neutralisation of the acid or anhydride in situ, but there is no mention of high active compositions.

GB 1 285 582, published Aug. 16, 1972, discloses a composition substantially containing 25–90% succinic acid, which may be derived from the anhydride, and 10–75% nonionic surfactant. There is no disclosure of a suitable process for making such compositions.

However, none of the prior art deals with the problem of making a highly concentrated solution of succinic acid which is suitable for further processing into a concentrated liquid detergent. There is a need for a process of hydrolysis of succinic anhydrides which can be carried out effectively in an environment in which very little water is present.

The present invention provides a new process for hydrolysis of the succinic anhydride to yield a solution of at least 85% by weight of partly neutralised succinic acid. The process can be carried out in situ, continuously or batchwise, and offers a flexible process for making a concentrated liquid detergent.

SUMMARY OF THE INVENTION

A process for making a concentrated liquid detergent composition which comprises (A) succinic acid

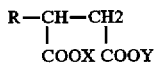

where R is a $C_{10}$–$C_{20}$ aklyl or $C_{10}$–$C_{20}$ alkenyl moiety; X and Y are each independently H, Na, K, or alkanolamine, and (B) water, characterised in that succinic anhydride, water and an alkaline catalyst are:

i) mixed in a ratio of succinic anhydride to water (B) of not less than 4:1 by weight in order to start an exothermic hydrolysis reaction ii) held in a buffer tank, and iii) mixed with other detergent ingredients.

DETAILED DESCRIPTION OF THE INVENTION

The present invention provides a process for the hydrolysis of succinic anhydride to succinic acid in the presence of a small excess of water. The process takes place in the presence of an alkali which catalyses the reaction and partly neutralises the succinic acid. Firstly the succinic anhydride, water and alkali are intimately mixed, either by passing through static mixers, or, preferably, in a high shear mixer. The mixture is then stored in a buffer tank (which may be in-line in a continuous process) until the exothermic hydrolysis reaction is substantially completed. The resulting high active partly neutralised succinic acid may then be stored or transferred directly into a batch tank or continuous process for further processing to a concentrated liquid detergent.

THE SUCCINIC ANHYDRIDE

Any succinic anhydride of the general formula:

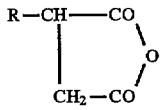

is suitable for use in the present invention. The choice of R will be made by the detergent formulator.

A particularly preferred chain is when:

R is $CH_3$—$(CH_2)_n$—CH=CH—$CH_2$ and n=8–10 or mixtures thereof.

THE ALKALI

Any suitable alkali may be used including sodium hydroxide, potassium hydroxide, monoethanolamine and ammonia. Preferred are sodium hydroxide and potassium hydroxide. The molar ratio of hydroxide present: hydroxide needed for stoichiometric neutralisation, should be 0.15 or less.

The alkali may be added to the succinic acid in the form of a solution (typically 50% aqueous solution of either sodium or potassium hydroxide). Extra water may also be added in order to ensure complete hydrolysis by the following reaction:

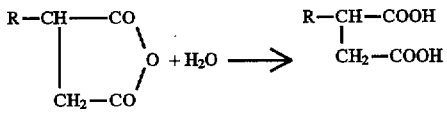

However total water which is present (both added and with the aqueous alkali) should be limited in order to avoid diluting the final composition, and to avoid an excessively long reaction time. It has been found that the ratio of succinic anhydride to water should be not less than 4:1 by weight.

THE HYDROLYSIS PROCESS

The reactants are brought together and mixed, preferably in a high shear mixer. Suitable mixers include Pentax (trade name), supplied by Bran and Luebbe, Germany; Dispax (trade name), supplied by Janke and Kunkel, and mixers supplied by Karg and Fryma. This mixture is then pumped into buffer tank where the hydrolysis reaction will proceed. Preferably the buffer tank already contains an amount of succinic acid which itself promotes rapid hydrolysis of the mixture. In a most preferred embodiment, the buffer tank is in-line in a continuous process and gives a residence time sufficient for hydrolysis to be substantially completed. In this embodiment of the invention the buffer tank contains at all times a mixture of succinic acid, water, alkali and partly neutralised succinic anhydride. The hydrolysis reaction is exothermic, and the temperature rises, preferably to about 90° C. The buffer tank should be gently stirred or agitated in order to keep the reactants mixed. In the case of a continuous process the buffer tank should be designed to give a residence time of from 2 to 30 minutes, preferably from 5 to 20 minutes.

The high active succinic acid made according to the above ratios and process has a pH of less than 5.5, preferably about pH4.5 when it is diluted to a 0.5% aqueous solution. Furthermore, after hydrolysis the ratio of partly neutralised succinic acid to water will not be less than about 6:1 by weight.

START-UP AND SHUT-DOWN PROCEDURE

When a continuous process is in use as described hereinabove, the process is shut-down by firstly closing the supply of water and alkali to the mixer. The supply of succinic anhydride is allowed to continue until all water and alkali have been flushed through the mixer then this supply is also shut-down. This procedure ensures that no hydrolysis continues in the mixer whilst not in use. Preferably not all of the succinic acid is flushed through the buffer tank. This means that when the supplies of succinic anhydride, water and alkali are switched on for start-up, there is still some acid in the buffer tank to "seed" the hydrolysis reaction. During the period that the process is not operating, the buffer tank should be maintained at an elevated temperature (typically 60°–80° C.) in order to prevent solidification of the succinic acid/anhydride mix.

FURTHER PROCESSING

The highly active, partly neutralised succinic acid made by the present invention may subsequently be added to other detergent ingredients including surfactants, builders, chelants, enzymes and softening clays, in order to make a finished liquid detergent composition. An example of this is given hereinbelow. Preferably the high active succinic acid is mixed with compatible detergent ingredients which allow its temperature to be reduced below 60° C., before it is mixed with lower alcohols. Such short chain alcohols may be present in the final formulation as solvents, examples include ethanol, propanol, propane diol and glycerol. If the succinic acid and such solvents are present at temperatures in excess of 60° C., then undesirable side products such as esters may be formed. An intermediate composition may be formed which is a stable, pumpable liquid at temperatures below 60° C. This intermediate composition preferably consists of at least 40% by weight of partly neutralised succinic acid.

EXAMPLE 1

| | |
|---|---|
| Dodecyl/tetradecyl succinic anhydride | 300 kg/hour |
| Potassium hydroxide (50% aq. soln.) | 20 kg/hour |
| Water | 40 kg/hour |

Succinic anhydride, potassium hydroxide solution and water are supplied at ambient temperature from metering pumps at the rates described above, into a Pentax KMF8 (Trade Mark) high shear mixer.

This mixture is transferred directly from the outlet port of this mixer into the bottom of a buffer tank. The buffer tank has a diameter of about 0.4 m and a height of about 0.8 m, giving a residence time of about 17 minutes. The temperature in the buffer tank rises to 92° C. as the exothermic hydrolysis reaction takes place.

The reacted material leaving from the top of the buffer tank has a composition of:

| | |
|---|---|
| Dodecyl/tetradecyl succinic acid (partly neutralised) | 90% |
| Water | 10% |

and, when diluted to give an aqueous solution of 0.5% by weight, has a pH of 4.5.

In this example, the high active, partly neutralised succinic acid is mixed with a nonionic surfactant in the ratio of 1:1. The surfactant is supplied at ambient temperature and the resulting mix has a temperature of 55° C. The resulting mixture is a stable, pumpable intermediate composition at this temperature.

A finished composition is made by mixing the acid/surfactant mixture with other detergent ingredients as follows (all given as % by weight):

| | |
|---|---|
| Succinic acid/nonionic surfactant | 18 |
| Ethanol & 1,2 propane diol | 12 |
| Sodium hydroxide | 9* |
| Alkyl benzene sulphonic acid | 12 |
| Sodium alkyl sulphate | 2 |
| Citric acid | 7 |
| Enzymes and minors | 1 |
| Miscellaneous (suds suppressor, perfume etc.) | 1 |
| Water | to balance to 100% |

*Level of sodium hydroxide may be varied in order to give finished pH8

What is claimed is:

1. A process for making a concentrated liquid detergent composition comprising the steps:

(i) forming a succinic acid having the formula

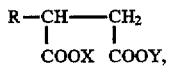

(I)

wherein R is a $C_{10}$–$C_{20}$ alkyl moiety or a $C_{10}$–$C_{20}$ alkenyl moiety, and X and Y are each independently selected from the group consisting of H, Na, K and alkanolamine, by a single exothermic hydrolysis reaction; and (ii) mixing the succinic acid with additional ingredients to form said concentrated liquid detergent composition;

wherein the single exothermic hydrolysis reaction comprises (a) mixing succinic anhydride of the formula

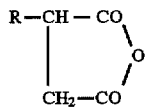

(II)

and water in a weight ratio of not less than 4:1 and in the presence of an alkaline catalyst; and (b) holding the mixture in a buffer tank wherein a product containing the succinic acid is formed via an exothermic hydrolysis reaction.

2. A process according to claim 1, wherein the process is continuous and the reactants have a residence time of at least 5 minutes in the buffer tank.

3. A process according to claim 1, wherein the alkaline catalyst is sodium hydroxide or potassium hydroxide and present in a molar ratio of:

hydroxide present: hydroxide needed for stoichiometric neutralization of the succinic acid (a) of 0.15 or less.

4. A process according to claim 3, wherein R is $CH_3$—$(CH_2)_n$—CH=CH—$CH_2$—and n=8–10 or mixtures thereof.

5. A process according to claim 2, wherein R is $CH_3$—$(CH_2)_n$—CH=CH—$CH_2$—and n=8–10 or mixtures thereof.

6. A process according to claim 1, wherein said product, when diluted to give an aqueous solution of 0.5% by weight, has a pH of less than 5.5.

7. A process according to claim 6, wherein the process is continuous and the reactants have a residence time of at least 5 minutes in the buffer tank.

8. A process according to claim 7, wherein R is $CH_3$—$(CH_2)_n$—CH=CH—$CH_2$—and n=8–10 or mixtures thereof.

9. A process according to claim 7, wherein the alkaline catalyst is sodium hydroxide or potassium hydroxide and present in a molar ratio of:

hydroxide present: hydroxide needed for stoichiometric neutralization of the succinic acid (a) of 0.15 or less.

10. A process according to claim 9 wherein R is $CH_3$—$(CH_2)_n$13 CH=CH—$CH_2$—and n=8–10 or mixtures thereof.

11. A process according to claim 7, wherein R is $CH_3$—$(CH_2)_n$—CH=CH—$CH_2$—and n=8–10 or mixtures thereof.

12. A process according to claim 6, wherein the alkaline catalyst is sodium hydroxide or potassium hydroxide and present in a molar ratio of:

hydroxide present: hydroxide needed for stoichiometric neutralization of the succinic acid (a) of 0.15 or less.

13. A process according to claim 12, wherein R is $CH_3$—$(CH_2)_n$—CH=CH—$CH_2$—and n=8–10 or mixtures thereof.

14. A process according to claim 6, wherein said product when diluted to give an aqueous solution Of 0.5% by weight, has a pH of about 4.5.

15. A process according to claim 6, wherein said product of step (ii) contains at least 85% by weight of the succinic acid (a).

16. A process according to claim 1, wherein the alkaline catalyst is sodium hydroxide or potassium hydroxide and present in a molar ratio of:

hydroxide present: hydroxide needed for stoichiometric neutralization of the succinic acid (a) of 0.15 or less.

17. A process according to claim 16, wherein R is $CH_3$—$(CH_2)_n$—CH=CH—$CH_2$—and n=8–10 or mixtures thereof.

18. A process according to claim 1, wherein R is $CH_3$—$(CH_2)_n$—CH=CH—$CH_2$—and n=8–10 or mixtures thereof.

* * * * *